US011674472B2

(12) United States Patent
Kubo et al.

(10) Patent No.: US 11,674,472 B2
(45) Date of Patent: Jun. 13, 2023

(54) CYLINDER COVER AND METHOD OF IMPROVING CORROSION RESISTANCE THEREOF

(71) Applicant: KAWASAKI JUKOGYO KABUSHIKI KAISHA, Kobe (JP)

(72) Inventors: Daichi Kubo, Kobe (JP); Yuto Sakane, Kobe (JP); Tomohiro Ueno, Kobe (JP); Ryo Morihashi, Kobe (JP); Hayato Iwasaki, Kobe (JP); Yuji Kamei, Kobe (JP); Hideaki Kurokawa, Kobe (JP); Yoshishige Sakai, Kobe (JP); Takayuki Imai, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/795,030

(22) PCT Filed: Feb. 13, 2020

(86) PCT No.: PCT/JP2020/005520
§ 371 (c)(1),
(2) Date: Jul. 25, 2022

(87) PCT Pub. No.: WO2021/161444
PCT Pub. Date: Aug. 19, 2021

(65) Prior Publication Data

US 2023/0081391 A1 Mar. 16, 2023

(51) Int. Cl.

| | |
|---|---|
| ***F02B 77/00*** | (2006.01) |
| ***F02F 1/36*** | (2006.01) |
| ***F02F 1/24*** | (2006.01) |

(52) U.S. Cl.
CPC . *F02F 1/36* (2013.01); *F02F 1/24* (2013.01)

(58) Field of Classification Search
CPC .. F01L 3/22; F01L 2303/00; F01P 3/14; F02F 1/40; B23K 11/0033
USPC ..... 123/195 C
See application file for complete search history.

(56) References Cited

U.S. PATENT DOCUMENTS

| | | | | | |
|---|---|---|---|---|---|
| 4,147,149 | A * | 4/1979 | Andrea | F01L 3/22 | 123/188.8 |
| 4,169,488 | A * | 10/1979 | Goloff | F01L 3/18 | 137/340 |
| 4,522,161 | A * | 6/1985 | Slee | F01P 3/14 | 123/41.85 |

(Continued)

FOREIGN PATENT DOCUMENTS

| | | | |
|---|---|---|---|
| JP | 2017-096219 | A | 6/2017 |
| JP | 2018-181600 | A | 11/2018 |

*Primary Examiner* — Long T Tran
*Assistant Examiner* — James J Kim
(74) *Attorney, Agent, or Firm* — Oliff PLC

(57) ABSTRACT

A method of improving corrosion resistance of a cylinder cover including a port that is an intake port or an exhaust port. The cylinder cover is configured such that an annular cooling water passage is formed between an inner peripheral surface of the port and a valve seat ring when the valve seat ring is inserted in the port. The method includes forming a weld overlay layer on each of sealed regions of the inner peripheral surface of the port by laser metal deposition using a welding material made of a nickel-based alloy, a copper alloy, stainless steel, or a titanium alloy, the sealed regions being positioned at both sides of the cooling water passage, respectively.

7 Claims, 2 Drawing Sheets

(56) References Cited

U.S. PATENT DOCUMENTS

| | | | | |
|---|---|---|---|---|
| 5,074,256 | A * | 12/1991 | Saito | F16N 7/12<br>123/41.77 |
| 2004/0182332 | A1 * | 9/2004 | Schellhase | F01L 3/12<br>123/41.85 |

* cited by examiner

CYLINDER COVER AND METHOD OF IMPROVING CORROSION RESISTANCE THEREOF

This is a U.S. National Phase Application of PCT/JP2020/005520 filed Feb. 13, 2020. The disclosure of the prior application is hereby incorporated by reference herein in its entirety.

TECHNICAL FIELD

The present invention relates to a cylinder cover of an internal combustion engine, and to a method of improving the corrosion resistance of the cylinder cover.

BACKGROUND ART

There are cases where a valve seat ring is mounted to a cylinder cover (also called "a cylinder head") of an internal combustion engine. The valve seat ring is a component that comes into contact with an intake valve or an exhaust valve when the valve closes. The valve seat ring is cooled by cooling water.

Specifically, the valve seat ring is inserted in an intake port or an exhaust port of the cylinder cover, and thereby an annular cooling water passage surrounding the valve seat ring is formed between the inner peripheral surface of the port and the valve seat ring (see Patent Literature 1, for example). At both sides of the cooling water passage (i.e., at one side and the other side in the axial direction of the port), sealing is made between the inner peripheral surface of the port and the valve seat ring to prevent leakage of the cooling water from the cooling water passage.

CITATION LIST

Patent Literature

PTL 1: Japanese Laid-Open Patent Application Publication No. 2017-96219

SUMMARY OF INVENTION

Technical Problem

Generally speaking, the cylinder cover is made of cast iron. In the case of such a cylinder cover made of cast iron, when a cooling water passage is formed between the inner peripheral surface of the port and the valve seat ring as described above, there is a risk of corrosion of sealed regions of the inner peripheral surface of the port, the sealed regions being positioned at both the sides of the cooling water passage.

Sealing is made between the valve seat ring and each of the sealed regions of the inner peripheral surface of the port by using a sealing member such as an O-ring, or by metal touch in which the valve seat ring is press-fitted into the port. In the case of the sealing using a sealing member such as an O-ring, even though the sealing member is pressed against each sealed region, since a minute gap still exists between the sealing member and the sealed region, crevice corrosion occurs. On the other hand, in the case of the sealing by metal touch, galvanic corrosion occurs due to a potential difference between dissimilar metals.

In order to prevent the above corrosion of the sealed regions of the inner peripheral surface of the port, for example, it is conceivable to form a weld overlay layer on each of the sealed regions, the weld overlay layer being made of a nickel-based alloy. For the formation of the weld overlay layer, it is conceivable to perform arc welding using a welding material (a rod or wire) made of the nickel-based alloy.

However, in the arc welding, at the weld overlay layer, the nickel-based alloy, of which the welding material is made, is diluted by the cast iron, of which the cylinder cover is made. For this reason, the corrosion of the sealed regions cannot be prevented so effectively.

In view of the above, an object of the present invention is to provide a method of improving the corrosion resistance of a cylinder cover, the method making it possible to effectively prevent the corrosion of the sealed regions, and to provide a cylinder cover having excellent corrosion resistance.

Solution to Problem in order to solve the above-described problems, a method of improving corrosion resistance of a cylinder cover according to the present invention is a method of improving corrosion resistance of a cylinder cover including a port that is an intake port or an exhaust port, the cylinder cover being configured such that a cooling water passage is formed between an inner peripheral surface of the port and a valve seat ring when the valve seat ring is inserted in the port. The method includes forming a weld overlay layer on each of sealed regions of the inner peripheral surface of the port by laser metal deposition using a welding material made of a nickel-based alloy, a copper alloy, stainless steel, or a titanium alloy, the sealed regions being positioned at both sides of the cooling water passage, respectively.

According to the above configuration, the weld overlay layer is formed by laser metal deposition, in which a heat input to the cylinder cover is low. This allows the composition of the weld overlay layer to be substantially the same as the composition of the welding material. Therefore, corrosion of the sealed regions can be prevented effectively.

The welding material may be made of a nickel-based alloy, and the nickel-based alloy may have a composition of 40 mass % or more of Ni and 30 mass % or less of Fe. According to this configuration, better corrosion resistance can be obtained compared to, for example, a case where a welding material containing about 50 mass % of Ni and about 50 mass % of Fe is used.

The cylinder cover may be provided with a side hole that is open in a passage region positioned between the sealed regions of the inner peripheral surface of the port, the side hole communicating with the cooling water passage. The method may further include: forming the weld overlay layer on the passage region except a portion thereof around the side hole; and performing peening on the entire weld overlay layer after forming the weld overlay layer. According to this configuration, large part of the passage region of the inner peripheral surface of the port is covered by the weld overlay layer. This makes it possible to prevent erosion of the passage region. Incidentally, in a case where the weld overlay layer is formed on the entire passage region, tensile residual stress occurs on the inner peripheral surface of the side hole. In this respect, by forming the weld overlay layer on the passage region except the portion thereof around the side hole, the occurrence of the tensile residual stress on the inner peripheral surface of the side hole can be prevented.

Due to solidification shrinkage of molten metal at the time of forming the weld overlay layer, the weld overlay layer becomes a tensile stress field. Also in the vicinity of an interface between the base material of the cylinder cover and the weld overlay layer, tensile residual stress occurs due to the solidification shrinkage of the molten metal at the time of forming the weld overlay layer. Therefore, by performing peening on the entire weld overlay layer after forming the weld overlay layer as in the above-described configuration, compressive residual stress can be imparted not only to the weld overlay layer, but also to the vicinity of the interface between the weld overlay layer and the base material. This makes it possible to prevent a decrease in the fatigue strength of the cylinder cover.

The method may further include performing the peening on the portion of the passage region around the side hole after forming the weld overlay layer. According to this configuration, compressive residual stress can be imparted also to the portion of the passage region around the side hole. This makes it possible to more effectively prevent a decrease in the fatigue strength of the cylinder cover.

The welding material may be a powder. Since the inside of the port is a relatively small space, in a case where the welding material is a wire, special devising is necessary to stably feed the welding material to a molten pool formed on the inner peripheral surface of the port. On the other hand, in a case where the welding material is a powder, stable feeding of the welding material to the molten pool can be readily performed.

Forming the weld overlay layer may include performing the laser metal deposition while rotating the cylinder cover about a central axis of the port. According to this configuration, a nozzle that discharges a laser beam and the welding material toward the inner peripheral surface of the port can be kept fixed, which makes it possible to prevent twisting and deformation of, for example, cables and tubes connected to the nozzle.

A cylinder cover according to the present invention includes a port that is an intake port or an exhaust port. A cooling water passage is formed between an inner peripheral surface of the port and a valve seat ring when the valve seat ring is inserted in the port. A weld overlay layer is formed on each of sealed regions of the inner peripheral surface of the port, the sealed regions being positioned at both sides of the cooling water passage, respectively. The weld overlay layer is made of a nickel-based alloy that has a composition of 40 mass % or more of Ni and 30 mass % or less of Fe.

The above configuration makes it possible to achieve excellent corrosion resistance.

Advantageous Effects of Invention

The method of improving corrosion resistance of a cylinder cover according to the present invention makes it possible to effectively prevent the corrosion of the sealed regions. The cylinder cover according to the present invention achieves excellent corrosion resistance.

DESCRIPTION OF EMBODIMENTS

Figure 1:
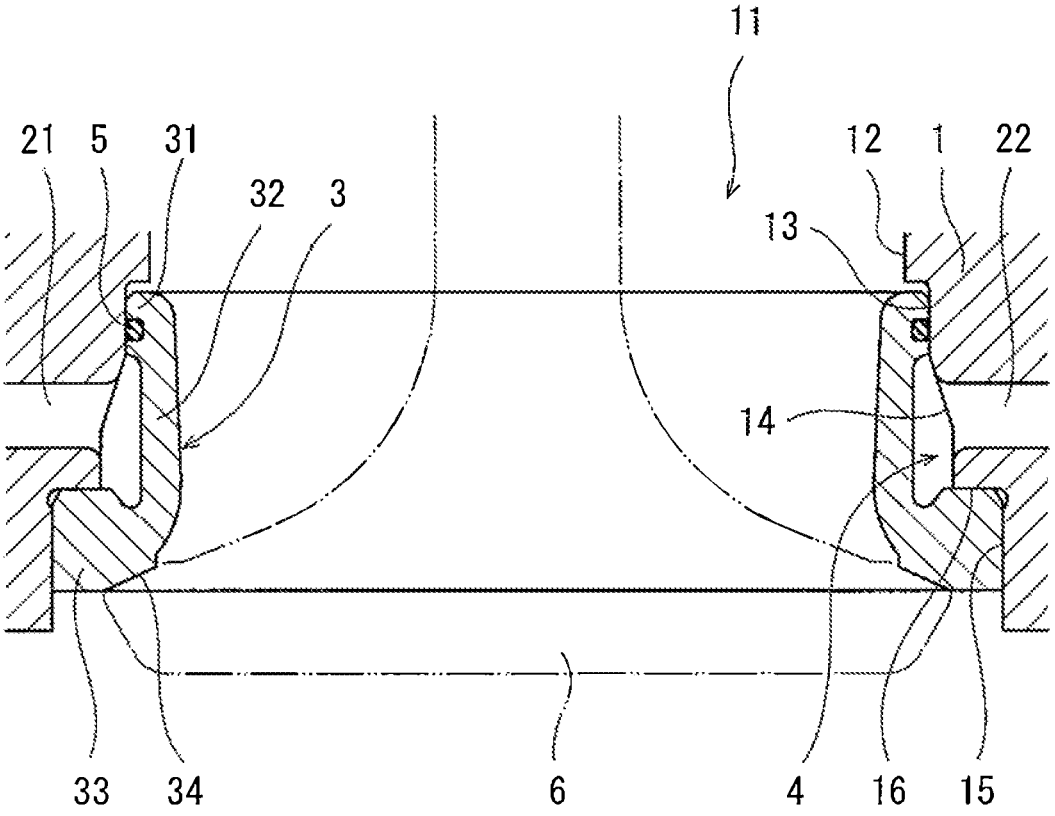
FIG. 1 is a sectional view of a cylinder cover (and a valve seat ring), to which a method of improving corrosion resistance according to one embodiment of the present invention is applied.

FIG. 1 shows a cylinder cover 1, to which a method of improving corrosion resistance according to one embodiment of the present invention is applied. A valve seat ring 3 is mounted to the cylinder cover 1.

Specifically, the cylinder cover 1 includes a port 11, which is an intake port or an exhaust port. The port 11 is open toward a combustion chamber. The opening of the port 11 toward the combustion chamber is opened and closed by a valve 6 (an intake valve or an exhaust valve). Generally speaking, the cylinder cover 1 is provided with two or four such ports 11. Hereinafter, for the sake of convenience of the description, the combustion chamber side of the port 11 in its axial direction may be referred to as the lower or downward side, and the opposite side of the port 11 from the combustion chamber may be referred to as the upper or upward side.

The valve seat ring 3 includes a valve seat 34, which comes into contact with the valve 6 when the valve 6 closes. The valve seat ring 3 is inserted in the port 11. As a result, an annular cooling water passage 4, which surrounds the valve seat ring 3, is formed between the valve seat ring 3 and an inner peripheral surface 12 of the port 11.

To be more specific, the valve seat ring 3 includes: a tubular portion 32, which extends in the axial direction of the port 11; a smaller-diameter portion 31, which protrudes radially outward from the upper end of the tubular portion 32; and a larger-diameter portion 33, which protrudes radially outward from the lower end of the tubular portion 32. That is, the smaller-diameter portion 31, the tubular portion 32, and the larger-diameter portion 33 form an annular groove that is open radially outward. The annular groove is covered by the inner peripheral surface 12 of the port 11, and thus the cooling water passage 4 is formed. The above-described valve seat 34 is part of the lower surface of the larger-diameter portion 33.

The inner peripheral surface 12 of the port 11 includes: a first sealed region 13 and a second sealed region 15, which are positioned at both sides of the cooling water passage 4 in the axial direction of the port 11; and a passage region 14 positioned between the first sealed region 13 and the second sealed region 15. The first sealed region 13 is a region that faces the outer peripheral surface of the smaller-diameter portion 31 of the valve seat ring 3. The second sealed region 15 is a region that faces the outer peripheral surface of the larger-diameter portion 33 of the valve seat ring 3. The passage region 14 is a region that covers the annular groove that is formed by the smaller-diameter portion 31, the tubular portion 32, and the larger-diameter portion 33 of the valve seat ring 3.

The first sealed region 13 and the second sealed region 15 are tubular and parallel to the axial direction of the port 11. On the other hand, although the lower part of the passage region 14 is parallel to the axial direction of the port 11, the diameter of the upper part of the passage region 14 increases downward from the lower end of the first sealed region 13.

The diameter of the lower part of the passage region 14 is set to be less than the diameter of the second sealed region 15. Accordingly, between the lower end of the passage region 14 and the upper end of the second sealed region 15, there is a stepped region 16, which is parallel to the radial direction of the port 11. The stepped region 16 serves to position the valve seat ring 3.

The cylinder cover 1 is provided with a first side hole 21 and a second side hole 22, which are open in the passage region 14 and communicate with the cooling water passage 4. Cooling water is fed into the cooling water passage 4 through the first side hole 21, and is drained from the cooling water passage 4 through the second side hole 22. The diameter of the first side hole 21 and the diameter of the second side hole 22 may be the same, or may be different from each other.

Figure 2:
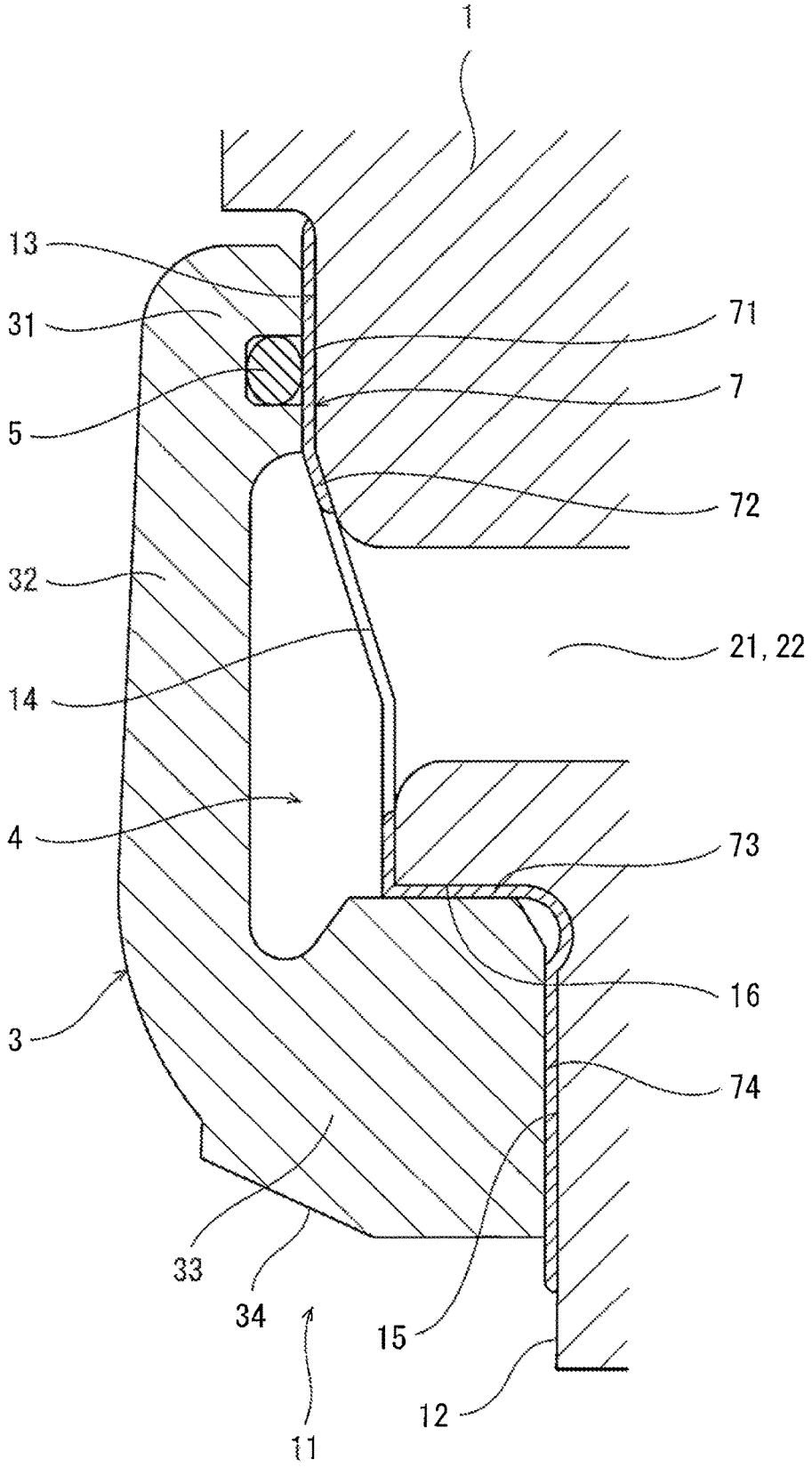
FIG. 2 is an enlarged view of an essential part of FIG. 1.

In the present embodiment, as shown in FIG. 2, a weld overlay layer 7 is formed on the inner peripheral surface 12 of the port 11 (in FIG. 1, the illustration of the weld overlay layer 7 is omitted). Specifically, the weld overlay layer 7 includes: a first weld overlay portion 71 formed on the first sealed region 13; a second weld overlay portion 72 formed on the passage region 14; a third weld overlay portion 73 formed on the stepped region 16; and a fourth weld overlay portion 74 formed on the second sealed region 15.

The weld overlay layer 7 is formed by laser metal deposition (hereinafter, "LMD"). In order to improve the corrosion resistance of the cylinder cover 1, a welding material made of a nickel-based alloy, a copper alloy, stainless steel, or a titanium alloy is used in the LAID. In the present embodiment, a welding material made of a nickel-based alloy is used in the LAID.

The nickel-based alloy, of which the welding material is made, has a composition of, for example, 30 mass % or more of Ni, 0 to 51 mass % of Fe, 0 to 30 mass % of Mo, and 0 to 25 mass % of Cr. Examples of the nickel-based alloy having such a composition include Inconel (registered trademark), Hastelloy (registered trademark), and Incoloy (registered trademark).

In particular, by using a welding material made of a nickel-based alloy having a composition of 40 mass % or more of Ni and 30 mass % or less of Fe, better corrosion resistance can be obtained compared to, for example, a case where a welding material containing about 50 mass % of Ni and about 50 mass % of Fe is used.

The welding material may be a wire, or may be a powder. In the present embodiment, the welding material is a powder. A laser beam and the welding material are discharged from an unshown nozzle toward the inner peripheral surface 12 of the port 11. Shielding gas may be discharged from the nozzle. The nozzle may be a single nozzle, or may be divided into a nozzle that discharges the laser beam and a nozzle that discharges the welding material.

At the time of forming the weld overlay layer 7 on the inner peripheral surface 12 of the port 11, the LAID may be performed while moving the nozzle in the circumferential direction of the port 11 in a state where the cylinder cover 1 is fixed. However, desirably, the LIPID is performed while rotating the cylinder cover 1 about the central axis of the port 11, because in this manner, the nozzle can be kept fixed, which makes it possible to prevent twisting and deformation of, for example, cables and tubes connected to the nozzle. Particularly in the present embodiment, since the welding material is a powder, a powder feeding tube is connected to the nozzle. Therefore, by preventing deformation of the powder feeding tube, a feeding amount of the powder can be kept constant.

At the time of forming each of the first weld overlay portion 71, the second weld overlay portion 72, and the fourth weld overlay portion 74 of the weld overlay layer 7, the LIM is performed in such a manner that beads extending in the circumferential direction are arranged in the axial direction of the port 11. At the time of forming the third weld overlay portion 73, the LAID is performed in such a manner that beads extending in the circumferential direction are arranged in the radial direction of the port 11.

At the time of forming the second weld overlay portion 72, desirably, the second weld overlay portion 72 is formed on the passage region 14 except portions thereof around the first side hole 21 and the second side hole 22 as shown in NG. 2, Of the passage region 14, the portions around the first side hole 21 and the second side hole 22 are ring-shaped portions whose internal diameters are the diameters of the first and second side holes 21 and 22, respectively, and each of these ring-shaped portions has a predetermined width.

In a case where the second weld overlay portion 72 is formed on the entire passage region 14, tensile residual stress occurs on the inner peripheral surface of each of the first side hole 21 and the second side hole 22. In this respect, by forming the second weld overlay portion 72 on the passage region 14 except the portions thereof around the first side hole 21 and the second side hole 22, the occurrence of the tensile residual stress on the inner peripheral surface of each of the first side hole 21 and the second side hole 22 can be prevented.

After the weld overlay layer 7 is formed on the inner peripheral surface 12 of the port 11, peening may be performed on the entire weld overlay layer 7. Due to solidification shrinkage of molten metal at the time of forming the weld overlay layer 7, the weld overlay layer 7 becomes a tensile stress field. Also in the vicinity of an interface between the base material of the cylinder cover 1 and the weld overlay layer 7, tensile residual stress occurs due to the solidification shrinkage of the molten metal at the time of forming the weld overlay layer 7. Therefore, by performing peening on the entire weld overlay layer 7 after forming the weld overlay layer 7, compressive residual stress can be imparted not only to the weld overlay layer 7, but also to the vicinity of the interface between the weld overlay layer 7 and the base material. This makes it possible to prevent a decrease in the fatigue strength of the cylinder cover 1.

Further, in the case of performing the peening, the peening may be performed also on the portions of the passage region 14 around the first side hole 21 and the second side hole 22 (i.e., the portions on which the second weld overlay portion 72 is not formed). According to this configuration, compressive residual stress can be imparted also to the portions of the passage region 14 around the first side hole 21 and the second side hole 22. This makes it possible to more effectively prevent a decrease in the fatigue strength of the cylinder cover 1.

Desirably, the peening performed herein is hammer peening, by which impact dents each having a diameter of about 2 to 10 mm are formed.

After the weld overlay layer 7 is formed on the inner peripheral surface 12 of the port 11 (in the case of performing the peening, after the peening is performed), the surface of the weld overlay layer 7 is cut by mechanical machining to achieve desired dimensional precision.

When the valve seat ring 3 is inserted in the port 11, the upper surface of the larger-diameter portion 33 of the valve seat ring 3 contacts the third weld overlay portion 73, which is formed on the stepped region 16 of the inner peripheral surface 12 of the port 11, and thereby positioning of the valve seat ring 3 in relation to the cylinder cover 1 is performed.

At the upper side and the lower side of the cooling water passage 4, sealing is made between the valve seat ring 3 and the inner peripheral surface 12 of the port 11 to prevent leakage of the cooling water from the cooling water passage 4. In the present embodiment, at the upper side of the cooling water passage 4, sealing using a sealing member 5 (e.g., an O-ring) is adopted, and at the lower side of the cooling water passage 4, metal touch sealing is adopted. Alternatively, at the lower side of the cooling water passage 4, sealing using the sealing member 5 may be adopted.

To be more specific, at the upper side of the cooling water passage 4, the external diameter of the smaller-diameter portion 31 of the valve seat ring 3 is set to be less than the internal diameter of the first weld overlay portion 71 formed on the first sealed region 13 by a dimensional tolerance. An annular groove that is open radially outward is formed in the outer peripheral surface of the smaller-diameter portion 31, and the sealing member 5 is inserted in the annular groove.

On the other hand, at the lower side of the cooling water passage 4, the external diameter of the larger-diameter portion 33 is set to be greater than the internal diameter of the fourth weld overlay portion 74 by a dimensional tolerance, such that the larger-diameter portion 33 of the valve seat ring 3 is press-fitted to the inside of the fourth weld overlay portion 74 formed on the second sealed region 15.

As described above, in the present embodiment, the weld overlay layer 7 is formed on the inner peripheral surface 12 of the port 11 (to be exact, from the first sealed region 13 to the second sealed region 15) by LMD, in which a heat input to the cylinder cover 1 is low. This allows the composition of the weld overlay layer 7 to be substantially the same as the composition of the welding material. Therefore, corrosion of the first sealed region 13 and the second sealed region 15 can be prevented effectively.

Since the inside of the port 11 is a relatively small space, in a case where the welding material is a wire, special devising is necessary to stably feed the welding material to a molten pool formed on the inner peripheral surface 12 of the port 11. On the other hand, in a case where the welding material is a powder as in the present embodiment, stable feeding of the welding material to the molten pool can be readily performed.

Variations

The present invention is not limited to the above-described embodiment. Various modifications can be made without departing from the scope of the present invention.

For example, the weld overlay layer 7 need not be formed on the passage region 14 of the inner peripheral surface 12 of the port 11. In other words, the weld overlay layer 7 need not include the second weld overlay portion 72. However, in a case where the weld overlay layer 7 is formed on the passage region 14 as in the present embodiment, large part of the passage region 14 is covered by the weld overlay layer 7. This makes it possible to prevent erosion of the passage region 14.

Moreover, the forming of the weld overlay layer 7 on the inner peripheral surface 12 of the port 11 is effective also as repairing of a corroded part of the cylinder cover 1.

The invention claimed is:

1. A method of improving corrosion resistance of a cylinder cover including a port that is an intake port or an exhaust port, the cylinder cover being configured such that a cooling water passage is formed between an inner peripheral surface of the port and a valve seat ring when the valve seat ring is inserted in the port, the method comprising forming a weld overlay layer on each of sealed regions of the inner peripheral surface of the port by laser metal deposition using a welding material made of a nickel-based alloy, a copper alloy, stainless steel, or a titanium alloy, the sealed regions being positioned at both sides of the cooling water passage, respectively.

2. The method of improving corrosion resistance of a cylinder cover according to claim 1, wherein the welding material is made of a nickel-based alloy, and the nickel-based alloy has a composition of 40 mass % or more of Ni and 30 mass % or less of Fe.

3. The method of improving corrosion resistance of a cylinder cover according to claim 1, wherein the cylinder cover is provided with a side hole that is open in a passage region positioned between the sealed regions of the inner peripheral surface of the port, the side hole communicating with the cooling water passage, the method further comprises:

forming the weld overlay layer on the passage region except a portion thereof around the side hole; and performing peening on the entire weld overlay layer after forming the weld overlay layer.

4. The method of improving corrosion resistance of a cylinder cover according to claim 3, the method further comprising performing the peening on the portion of the passage region around the side hole after forming the weld overlay layer.

5. The method of improving corrosion resistance of a cylinder cover according to claim 1, wherein the welding material is a powder.

6. The method of improving corrosion resistance of a cylinder cover according to claim 1, wherein forming the weld overlay layer includes performing the laser metal deposition while rotating the cylinder cover about a central axis of the port.

7. A cylinder cover comprising a port that is an intake port or an exhaust port, wherein a cooling water passage is formed between an inner peripheral surface of the port and a valve seat ring when the valve seat ring is inserted in the port, a weld overlay layer is formed on each of sealed regions of the inner peripheral surface of the port, the sealed regions being positioned at both sides of the cooling water passage, respectively, the weld overlay layer is made of a nickel-based alloy that has a composition of 40 mass % or more of Ni and 30 mass % or less of Fe.

* * * * *